US009060653B2

(12) United States Patent
Henderson et al.

(10) Patent No.: US 9,060,653 B2
(45) Date of Patent: Jun. 23, 2015

(54) BATH SPOUT COVER

(71) Applicant: SKIP HOP, INC, New York, NY (US)

(72) Inventors: Scott Henderson, Brooklyn, NY (US); Janet Villano, Jersey City, NY (US); Ellen Diamant, New York, NY (US); Elizabeth Zack, Brooklyn, NY (US)

(73) Assignee: SKIP HOP, INC., New York, NY (US)

( * ) Notice: Subject to any disclaimer, the term of this patent is extended or adjusted under 35 U.S.C. 154(b) by 298 days.

(21) Appl. No.: 13/863,785

(22) Filed: Apr. 16, 2013

(65) Prior Publication Data

US 2013/0224427 A1 Aug. 29, 2013

Related U.S. Application Data

(63) Continuation of application No. 12/511,652, filed on Jul. 29, 2009, now Pat. No. 8,424,129.

(51) Int. Cl.

| | |
|---|---|
| ***A47K 17/00*** | (2006.01) |
| ***A47K 3/00*** | (2006.01) |
| ***E03C 1/04*** | (2006.01) |

(52) U.S. Cl.

CPC ..... *A47K 3/005* (2013.01); *Y10T 428/24008* (2015.01); *Y10T 29/49826* (2015.01); *Y10T 137/7043* (2015.04); *E03C 1/0404* (2013.01)

(58) Field of Classification Search

CPC ..... A47K 17/00
USPC ..... 4/661, 675
See application file for complete search history.

(56) References Cited

U.S. PATENT DOCUMENTS

| | | | | |
|---|---|---|---|---|
| 3,327,280 | A * | 6/1967 | Levine et al. | 439/135 |
| 4,353,139 | A * | 10/1982 | Wainwright et al. | 4/661 |
| D354,550 | S * | 1/1995 | Munoz | D23/256 |
| 6,205,598 | B1 * | 3/2001 | Black et al. | 4/580 |
| 2007/0130688 | A1 * | 6/2007 | Thorne et al. | 4/675 |

* cited by examiner

*Primary Examiner* — Huyen Le
(74) *Attorney, Agent, or Firm* — Stephen J. Weyer, Esq.; Terry L. Wright, Esq.; Stites & Harbison, PLLC

(57) ABSTRACT

A bath spout cover is provided that includes a body structure having an upper portion, two opposing side portions, and a front portion; a receiving area defined between the upper portion, the two opposing side portions, and the front portion; a strap spanning the two opposing side portions, said strap being adjustable on at least one of the side portions of the body structure; and at least one aperture defined by one of the side portions of the body structure, said aperture for receiving an end of the strap. Further provided are methods for securing a bath spout cover to a bath spout.

21 Claims, 3 Drawing Sheets

FIG. 1
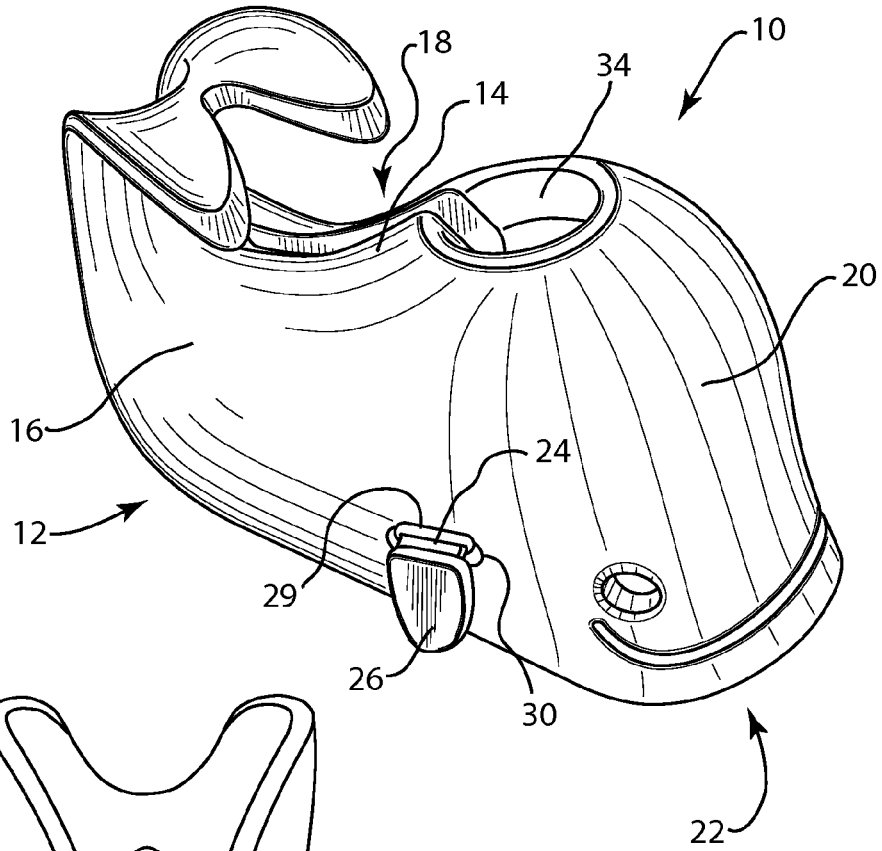
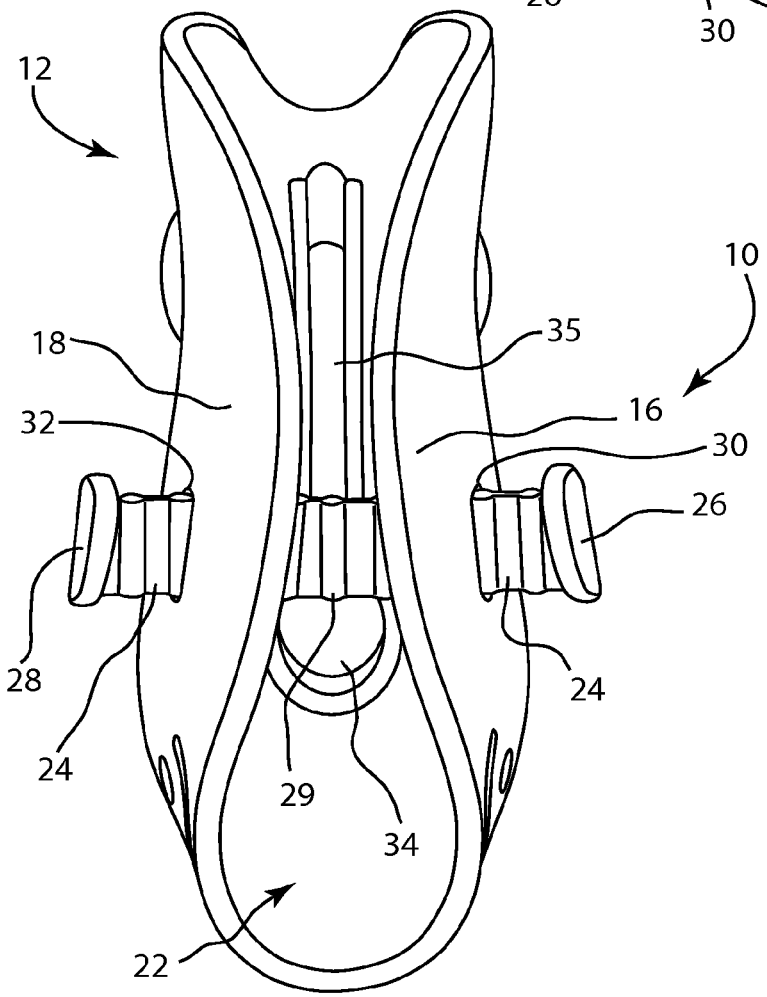
FIG. 2

BATH SPOUT COVER

RELATED APPLICATIONS

This application is a continuation of U.S. patent application Ser. No. 12/511,652, filed Jul. 29, 2009 and issued as U.S. Pat. No. 8,424,129 on Apr. 23, 2013, herein incorporated by reference.

TECHNICAL FIELD

The presently-disclosed subject matter relates to a cover for a bath spout and a method of securing a bath spout cover to a bath spout. In particular, the presently-disclosed subject matter relates to a bath spout cover and a method for securing a bath spout cover that make use of an adjustable strap for securing the cover to a bath spout.

BACKGROUND

Covers for bath spouts are routinely used to not only provide a decorative appearance to bath spouts, but also to protect individuals, including children, from personal injury. Accidents frequently occur in bathtubs as a result of slipping on a wet surface or simply as a result of children playing in a bathtub. These accidents often cause pain and personal injury due to the individual hitting his or her head, or other portions of their body, against the bath spout. To that end, numerous protective covers have been designed and manufactured for bath spouts.

The majority of the protective covers that are currently available for bath spouts are formed from plastics, such as poly-vinyl chloride, and are able to protect individuals from pain and injury that may otherwise occur after the individual strikes their head or other body part against the bath spout. However, these plastic bath spout covers are routinely manufactured as solid or inflatable sleeves that slide over a particular bath spout and have limited or no adjustability, thus making them difficult to install and remove, and also making them inconvenient for storage and drying after use. Alternative designs have produced bath spout covers that are relatively easily installed, but frequently fall off and, consequently, fail to provide sufficient protection for individuals. In any event, known covers for bath spouts are either difficult to install and remove, or can not be adequately secured to a bath spout to provide a requisite degree of protection. Furthermore, none of the known bath spout covers sufficiently provide a means to easily store the bath spout cover after use, which is of great importance in drying the bath spout cover and preventing mold and mildew formation.

SUMMARY

The presently-disclosed subject matter includes bath spout covers and methods of securing a bath spout cover to a bath spout.

In one exemplary embodiment, a bath spout cover is provided that comprises a body structure having an upper portion, two opposing side portions, and a front portion that defines a receiving area. An adjustable strap spans the two opposing side portions, and an end of the strap is received by at least one aperture, which is defined by one of the side portions of the body structure. In some exemplary embodiments, a second aperture, which is defined by the other side portion of the body structure, is provided for receiving the other end of the strap. The two opposing side portions and the front portion of the body structure further define an open bottom of the bath spout cover such that the bath spout cover is easily positioned on a bath spout and the bath spout is received by the receiving area.

To secure the bath spout cover to a bath spout, the strap spanning the two opposing side portions is typically positioned under the bath spout. In some exemplary embodiments, the strap is permanently attached to one of the side portions of the body structure and is detachable from the other side portion of the body structure such that one end of the strap remains attached to the bath spout cover while it is positioned on bath spout. Alternatively, in some embodiments, the strap is detachable from each side portion of the body structure such that the body structure can be first positioned on a bath spout and then the strap can be attached to each side portion of the body structure.

Depending on whether one or both ends of the strap are detachable from the body structure, an exemplary bath spout cover of the presently-disclosed subject matter is secured to a bath spout by adjusting the strap on either one or both side portions of the body structure. In some exemplary embodiments, the strap includes a plurality of ridges that are positioned at predetermined intervals along the length of the strap such that when the strap is adjusted on one or both side portions of the body structure, the ridges engage the apertures in the side portions of the body structure to thereby secure the cover to the bath spout. In some embodiments, the end of the strap extends in a direction that is perpendicular to a longitudinal axis of the strap to secure the strap in the aperture and prevent the cover from easily falling off of the spout.

In other exemplary embodiments of the presently-disclosed bath spout cover, one or more additional features can be included to facilitate the use and the aesthetic appearance of an exemplary bath spout cover. In some embodiments, the top portion of an exemplary bath spout cover includes an opening that is adapted to fit over a bath spout shower diverter and a hooked portion for hanging the bath spout cover. Further, in some embodiments, in order to provide a more aesthetically-pleasing bath spout cover and to enhance the cover's appeal to children, an exemplary bath spout cover can be provided in the shape of an animal, such as a whale, where certain features of the bath spout cover resemble various anatomical features of the particular animal.

Further provided, in some embodiments of the presently-disclosed subject matter, is a method for securing a bath spout cover to a bath spout. An exemplary method for securing a bath spout cover to a bath spout includes taking a bath spout cover in accordance with the present invention; positioning the bath spout cover on the bath spout such that the bath spout is located in the receiving area; and pulling the strap through at least one aperture in a side portion of the body structure to thereby secure the bath spout cover to the bath spout.

The presently-disclosed bath spout covers and methods of securing a bath spout cover to a bath spout allow a bath spout cover to be easily attached to and removed from a variety of different bath spouts, but yet still allow for the secure attachment of the cover to a particular spout. Further, the presently-disclosed bath spout covers can be fabricated from a variety of elastomeric materials to thereby provide a spout cover formed from a soft deformable material that provides an additional level of protection to an individual, such as a child.

BRIEF DESCRIPTION OF THE DRAWINGS

FIG. 1 is a perspective view of an exemplary bath spout cover in accordance with the presently-disclosed subject matter.

FIG. 2 is a bottom view of an exemplary bath spout cover.

DESCRIPTION OF EXEMPLARY EMBODIMENTS

Figure 3:
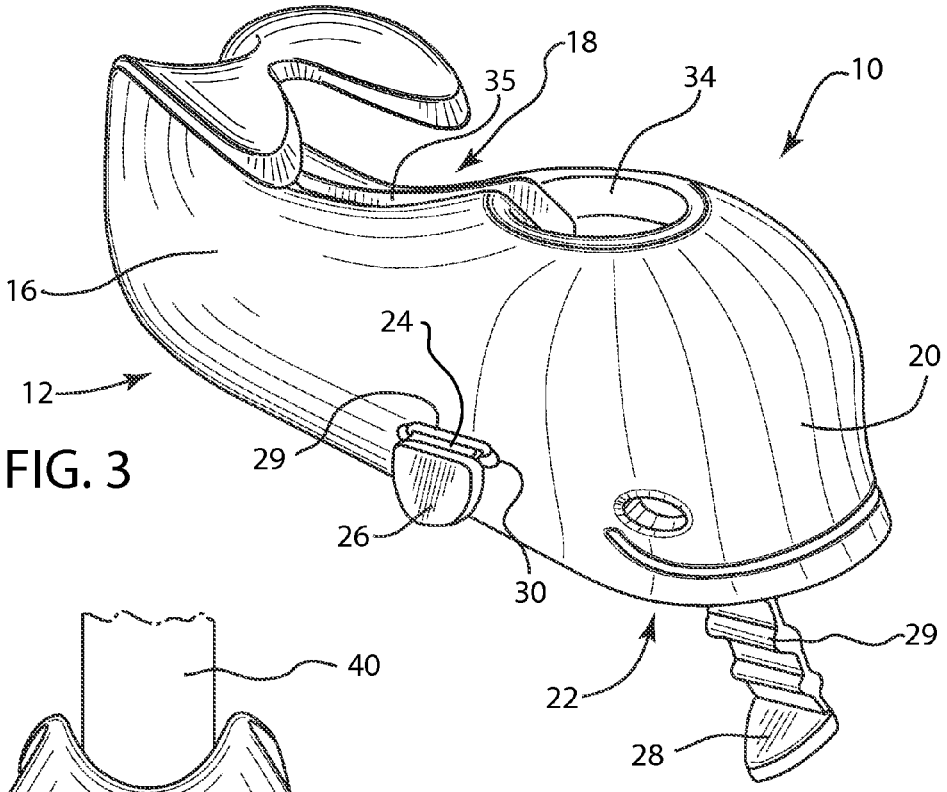
FIG. 3 is a perspective view of an exemplary bath spout cover similar to FIG. 1, but further illustrating the strap detached from one side of the bath spout cover.

The presently-disclosed subject matter includes bath spout covers and methods of securing a bath spout cover to a bath spout. In particular, the presently-disclosed subject matter includes bath spout covers and methods of securing a bath spout cover to a bath spout that make use of an adjustable strap for securing the cover to a bath spout.

FIG. 1 includes a perspective view of an exemplary bath spout cover in accordance with the presently-disclosed subject matter. In this exemplary embodiment, a bath spout cover 10 is provided that comprises a body structure 12 having an upper portion 14, two opposing side portions 16,18, and a front portion 20; a receiving area defined by the upper portion 14, the two opposing side portions 16,18, and the front portion 20; a strap 24 spanning the two opposing side portions 16,18; and, at least one aperture 30 defined by one of the side portions 16 of the body structure 12 for receiving an end 26 of the strap 24.

Referring now to FIG. 2, the two opposing side portions 16,18 and the front portion 20 of the body structure 12 further define an open bottom of the bath spout cover 10. By including an open bottom in the bath spout cover 10, an open configuration for the bath spout cover 10 is provided that allows the bath spout cover 10 to be suitably received by the receiving area 22 of the bath spout cover 10. For example, by providing an open bottom in the bath spout cover 10, the bath spout cover 10 can simply be placed over a particular bath spout such that the spout is positioned within the receiving area 22. Alternatively, depending on the desired configuration of the strap 24 of an exemplary bath spout cover 10 and the size and shape of a particular bath spout, the bath spout cover 10 can be slidably disposed onto a bath spout such that the bath spout is positioned within the receiving area 22 and the strap 24 is positioned under the bath spout while the strap 24 is attached to both sides portions 16,18 of the body structure 12.

As noted, a variety of configurations are possible for the straps of the presently-disclosed bath spout covers. Referring now to FIG. 3, in one exemplary embodiment, the strap 24 is permanently attached to one side portion 16 of the body structure 12, but is detachable from the other side portion 18 of the body structure 12. Of course, to the extent it may be desired, the strap can be permanently attached to the other side portion 18 the body structure 12 and detachable from the side portion 16 of the body structure 12 without departing from the spirit and scope of the presently-disclosed subject matter. In some embodiments of the presently-disclosed subject matter, the strap 24 is detachable from both sides portions 16, 18 of the body structure 12.

Figure 6:
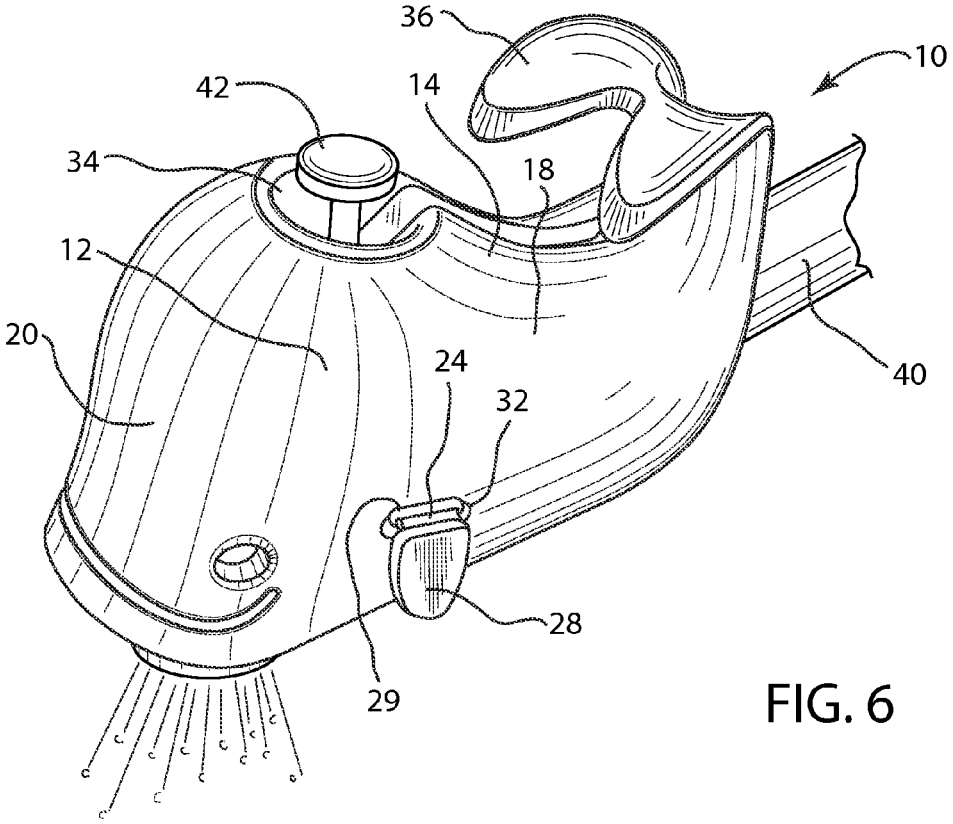
FIG. 6 is perspective view of an exemplary bath spout cover illustrating the bath spout cover attached to a bath spout.

Depending on whether one or both ends of the strap are detachable from the body structure, an exemplary bath spout cover 10 of the presently-disclosed subject matter is secured to a bath spout by adjusting the strap 24 on either one or both side portions 16,18 of the body structure 12. In exemplary embodiments where the strap is permanently attached to one side portion 16 of the body structure 12, as illustrated in FIG. 3, the first end 26 of the strap 24 is received by the aperture 30 defined in the side portion 16 of the body structure 12 and is in a fixed position. As illustrated in FIG. 6, the other end 28 of the strap 24, which is detachable from the other side portion 18 of the body structure 12, is received by a second aperture 32 in the other side portion 18 of the body structure 12. The other end 28 of the strap 24 is then pulled through the second aperture 32 to thereby tighten and secure the bath spout cover 12 to the bath spout 40. Alternatively, in exemplary embodiments where both ends 26,28 are detachable from the side portions 16,18 of the body structure 12, the ends 26,28 of the strap 24 can be received by both of the apertures 30,32 and pulled through the apertures 30,32 to thereby adjust the strap 24 on each side portion 16,18 of the body structure 12.

After the strap 24 is pulled through one or both of the apertures 30,32, the strap 24 can be maintained in an adjusted position to thereby secure an exemplary bath spout cover 10 to a bath spout. In one exemplary embodiment, as illustrated in FIG. 2, to maintain the strap 24 in an adjusted position, the strap 24 comprises a plurality of ridges 29 positioned at predetermined intervals along the length of the strap 24. When such a strap 24 is adjusted on one or both side portions 16,18 of a bath spout cover 10, the ridges 29 are pulled through the apertures 30,32 and engage the apertures 30, 32 on the exterior of the side portions 16,18 to thereby hold the strap 24 in an adjusted position and secure a bath spout cover 10 to a bath spout. Of course, to the extend it may be desired, various other means, such as snaps, buckles, or the like, can be employed as a means to maintain the strap 24 in an adjusted position without departing from the spirit and scope of the presently-disclosed subject matter.

In some exemplary embodiments, the ends 26,28 of the strap 24 extend in a direction that is perpendicular to the longitudinal axis of the strap 24. For example, as illustrated in FIG. 6, an end 28 of the strap 14 can extend in a direction that is perpendicular to the longitudinal axis of the strap 24 such that the end 28 of the strap 24 extends downward and away from the upper portion 14 of the body structure 12. By providing ends 26,28 of the strap 24 that are perpendicular to the longitudinal axis of the strap 24, the ends 26,28 of the strap 24 can be readily grasped by a user such that the strap can be easily adjusted. Further, the perpendicular ends 26,28 of the strap 24 also prevent the strap from sliding back through the apertures 30,32 in the side portions 16,18 of the body structure 12 and thereby further prevent the cover from easily falling off of a bath spout.

Figure 4:
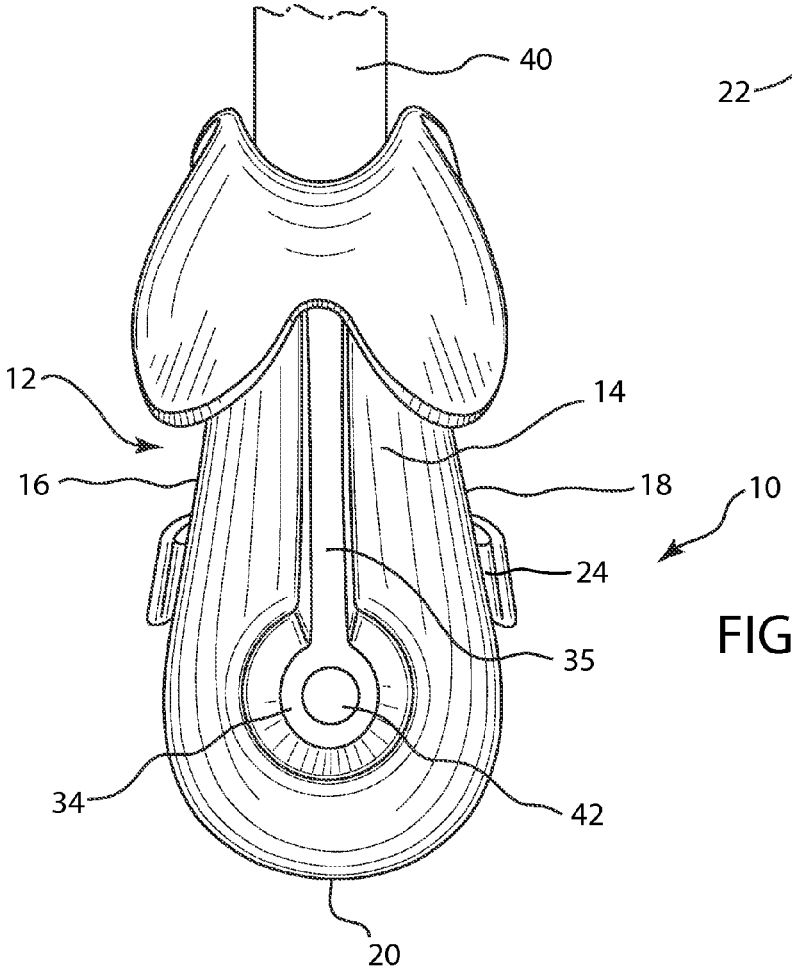
FIG. 4 is a top view of an exemplary bath spout cover, and showing the bath spout cover attached to a bath spout with a bath spout shower diverter being positioned in the opening of the top portion of the bath spout cover.
Figure 5:
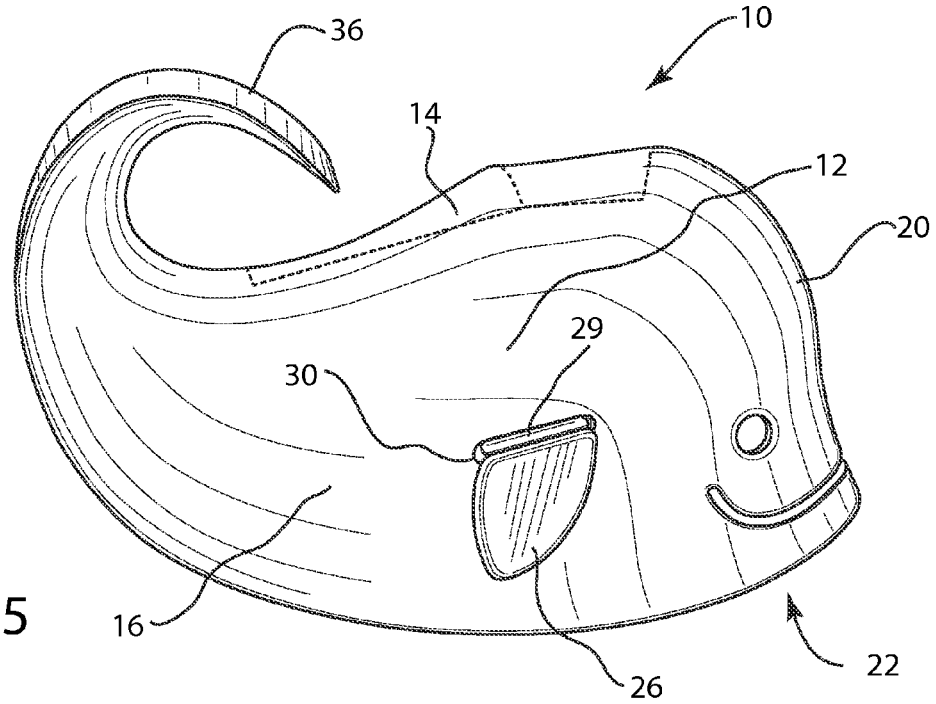
FIG. 5 is a left side view of an exemplary bath spout cover; the opposite side being nearly a mirror image.

Referring now to FIG. 4, in an exemplary embodiment of a bath spout cover 10, the top portion 14 of the body structure 12 defines an opening 34 that is adapted to fit over a bath spout shower diverter 42 of a bath spout 40. The opening 34 is typically a substantially circular opening such that an exemplary bath spout cover 10 can be placed over a variety of different bath spouts and a user can easily access a shower diverter 42 without removing the bath spout cover 10 from the bath spout 40. In some exemplary embodiments, an elongated void 35 extends from the opening 34 toward the back of the bath spout cover 10. When a bath spout cover 10 is secured onto a bath spout 40, the elongated void 35 decreases in width without substantially affecting the diameter of the opening 34 and without affecting a user's access to a shower diverter 42. Further, in some embodiments, the elongated void 35 enhances the adjustability of an exemplary bath spout cover 10 such that the bath spout cover 10 is able to accommodate bath spouts of varying sizes and shapes.

Referring now to FIG. 6, the top portion of an exemplary bath spout cover 10 can further comprise a hooked portion 36 for hanging the bath spout cover. By including a hooked portion 36, the bath spout cover 10 can be readily be hung over a towel bar or the like such that the bath spout cover 10 can hang and dry when not in use, and thereby decrease the likelihood of mold and mildew formation.

An exemplary bath spout cover 10 is typically fabricated from a deformable material, such as an elastomeric material, in order to provide an additional level of protection for individuals. Various elastomeric material can be used in accordance with the presently-disclosed subject matter and include elastomeric materials such as rubbers, plastics, or the like. In some embodiments, the body structure is fabricated from an elastomeric material such as a thermoplastic rubber or thermoplastic elastomer. In some embodiments, both the body structure and the strap are comprised of an elastomeric material. By fabricating an exemplary bath spout cover 10 from a suitable elastomeric material, an exemplary bath spout cover 10 can be provided that is not only resistant to mold and mildew formation, but that is also capable of being cleaned in a standard dishwasher where the bath spout cover 10 may be exposed to elevated temperatures. In some embodiments, to further enhance the resistance of an exemplary bath spout cover 10 to mold and mildew formation, an anti-fungal agent can be added to the elastomeric material during fabrication.

In some embodiments of the presently-disclosed subject matter, an exemplary bath spout cover 10 is advantageously composed of a thermoplastic rubber, a thermoplastic elastomer, or both such that an exemplary bath spout cover is provided that has a Shore A hardness in the range of 55 to 95, and preferably in the range of 75 to 85. In some embodiments, an exemplary bath spout cover 10 is provided that is comprised of a thermoplastic rubber or thermoplastic elastomer such that the bath spout cover 10 has a Shore A hardness of about 80.

In order to enhance the aesthetic appeal of the presently-disclosed bath spout covers and to increase the appeal of the covers for children, an exemplary bath spout cover 10 of the presently-disclosed subject matter can be provided in the shape of an animal, such as an alligator, fish, elephant, or the like, and the various features of the bath spout cover can be shaped to resemble the various anatomical features of the particular animal. For example, as illustrated in FIG. 6, in one exemplary embodiment, a bath spout cover 10 is provided in the shape of a whale. In this exemplary embodiment, the top portion 14 of the bath spout cover 10 defines an opening 34 that forms a blowhole of the whale and the ends 26,28 of the strap 24 form the fins of the whale. Further, in this exemplary embodiment, the top portion 14 of the bath spout cover 10 also comprises a hooked portion 36 for hanging the bath spout cover 10, which forms the tail of the whale.

Further provided in some embodiments of the presently-disclosed subject matter are methods for securing a bath spout cover to a bath spout. In one exemplary implementation of a method of securing a bath spout cover to a bath spout, a bath spout cover is first taken that comprises a body structure having an upper portion, two opposing side portions, and a front portion; a receiving area defined between the upper portion, the two opposing side portions, and the front portion; a strap spanning the two opposing side portions, said strap being adjustable on at least one of the side portions of the body structure; and at least one aperture defined by one of the side portions of the body structure for receiving an end of the strap. The bath spout cover is then positioned on a bath spout such that the bath spout is located in the receiving area of the bath spout cover, and the strap is then pulled through at least one aperture in a side portion of the body structure to thereby secure the bath spout cover to the bath spout. In some implementations, the body structure can include a second aperture in a side portion of the body structure such that the strap can be pulled through two separate apertures to thereby secure the bath spout cover to the bath spout.

In some implementations of the presently-disclosed methods of securing a bath spout cover to a bath spout, a bath spout cover is provided where the strap includes a plurality of ridges positioned at predetermined intervals along the length of the strap. In these exemplary implementations, pulling the strap causes at least one of the ridges to engage at least one aperture in the bath spout cover to thereby secure the cover to the spout.

One of ordinary skill in the art will recognize that additional embodiments are also possible without departing from the teachings of the presently-disclosed subject matter. This detailed description, and particularly the specific details of the exemplary embodiments disclosed herein, is given primarily for clarity of understanding, and no unnecessary limitations are to understood therefrom, for modifications will become apparent to those skilled in the art upon reading this disclosure and may be made without departing from the spirit or scope of the presently-disclosed subject matter.

What is claimed is:

1. A bath spout cover, comprising:

a body structure having an upper portion, two opposing side portions, and a front portion, said upper portion defining an elongated void extending along a length of the upper portion; a receiving area defined between the upper portion, the two opposing side portions, and the front portion;

a strap spanning the two opposing side portions, said strap for securing the bath spout cover to a bath spout; and at least one aperture defined by one of the side portions of the body structure, said aperture for receiving an end of the strap, wherein the end of the strap extends in a direction that is perpendicular to a longitudinal axis of the strap.

2. The bath spout cover of claim 1, wherein the two opposing side portions and the front portion define an open bottom of the bath spout cover for receiving a bath spout in the receiving area.

3. The bath spout cover of claim 1, further comprising a second aperture defined by the other side portion of the body structure, said second aperture for receiving the other end of the strap.

4. The bath spout cover of claim 1, wherein the strap is permanently attached to at least one of the side portions of the body structure.

5. The bath spout cover of claim 1, wherein the strap is detachable from each side portion of the body structure.

6. The bath spout cover of claim 1, wherein the strap is adjustable on each side portion of the body structure.

7. The bath spout cover of claim 1, wherein the strap comprises a plurality of ridges positioned at predetermined intervals along the length of the strap, and wherein said ridges engage the at least one aperture defined by one of the side portions of the body structure.

8. The bath spout cover of claim 1, wherein the upper portion further defines an opening adapted to fit over a bath spout shower diverter.

9. The bath spout cover of claim 1, wherein the upper portion further comprises a hooked portion for hanging the bath spout cover.

10. The bath spout cover of claim 1, wherein the body structure is comprised of an elastomeric material.

11. The bath spout cover of claim 9, wherein the strap is comprised of an elastomeric material.

12. A bath spout cover, comprising:

a body structure having an upper portion, two opposing side portions, and a front portion; a receiving area defined between the upper portion, the two opposing side portions, and the front portion, the upper portion defines an elongated void extending along substantially an entire length of the upper portion;

a strap operably connected to the two opposing side portions, said strap for securing the bath spout cover to a bath spout; and at least one aperture defined by one of the side portions of the body structure, said aperture for receiving an end of the strap.

13. The bath spout cover of claim 12, further comprising a second aperture defined by the other side portion of the body structure, said second aperture for receiving the other end of the strap.

14. The bath spout cover of claim 13, wherein the upper portion further defines an opening adapted to fit over a bath spout shower diverter.

15. A bath spout cover, comprising:

a body structure with an exterior facing surface, the body structure having an upper portion, two opposing side portions, and a front portion;

a receiving area defined between the upper portion, the two opposing side portions, and the front portion;

at least one aperture through one of the side portions, and a strap spanning the two opposing side portions and traversing the at least aperture, an end portion of the strap having a dimension larger than a dimension of the aperture, said end portion extending through said aperture and extending along the exterior facing surface of the body wherein part of the end portion abuts the exterior facing surface of the body structure, thereby holding the strap in place, said strap for securing the bath spout cover to a bath spout.

16. The bath spout cover of claim 15, wherein the end portion abutting the exterior surface prevents the strap from sliding back through the at least one aperture.

17. The bath spout cover of claim 15, wherein the at least two apertures comprised two apertures, one on each opposing side portion.

18. The bath spout cover of claim 15, wherein the body structure is comprised of an elastomeric material.

19. The bath spout cover of claim 18, wherein the strap is comprised of an elastomeric material.

20. The bath spout cover of claim 15, wherein the body structure is comprised of an elastomeric material having a Shore A hardness of about 55 to about 95.

21. The bath spout cover of claim 20, wherein the elastomeric material has a Shore A hardness of about 75 to about 85.

* * * * *

UNITED STATES PATENT AND TRADEMARK OFFICE

CERTIFICATE OF CORRECTION

PATENT NO. : 9,060,653 B2
APPLICATION NO. : 13/863785
DATED : June 23, 2015
INVENTOR(S) : Henderson et al.

It is certified that error appears in the above-identified patent and that said Letters Patent is hereby corrected as shown below:

In the Claims

Column 7, line 25 – column 8, line 18 please change:
"15. A bath spout cover, comprising: a body structure with an exterior facing surface, the body structure having an upper portion, two opposing side portions, and a front portion; a receiving area defined between the upper portion, the two opposing side portions, and the front portion; at least one aperture through one of the side portions, and a strap spanning the two opposing side portions and traversing the at least aperture, an end portion of the strap having a dimension larger than a dimension of the aperture, said end portion extending through said aperture and extending along the exterior facing surface of the body wherein part of the end portion abuts the exterior facing surface of the body structure, thereby holding the strap in place, said strap for securing the bath spout cover to a bath spout.

16. The bath spout cover of claim 15, wherein the end portion abutting the exterior surface prevents the strap from sliding back through the at least one aperture.

17. The bath spout cover of claim 15, wherein the at least two apertures comprised two apertures, one on each opposing side portion." TO --15. A bath spout cover, comprising: a body structure with an exterior facing surface, the body structure having an upper portion, two opposing side portions, and a front portion; a receiving area defined between the upper portion, the two opposing side portions, and the front portion; at least one aperture through one of the side portions, and a strap spanning the two opposing side portions and traversing the at least one aperture, an end portion of the strap having a dimension larger than a dimension of the aperture, said end portion extending through said aperture and extending along the exterior facing surface of the body wherein part of the end portion abuts the exterior facing surface of the body structure, thereby holding the strap in place, said strap for securing the bath spout cover to a bath spout.

Signed and Sealed this
Twenty-first Day of June, 2016

Michelle K. Lee

Michelle K. Lee
*Director of the United States Patent and Trademark Office*

16. The bath spout cover of claim 15, wherein the end portion abutting the exterior surface prevents the strap from sliding back through the at least one aperture.

17. The bath spout cover of claim 15, wherein the at least one aperture comprises two apertures, one on each opposing side portion.--